US006915191B2

(12) United States Patent
Kane et al.

(10) Patent No.: US 6,915,191 B2
(45) Date of Patent: Jul. 5, 2005

(54) METHOD AND SYSTEM FOR DETECTING WHEN AN END OF TRAIN HAS PASSED A POINT

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 52 days.

(21) Appl. No.: 10/440,129

(22) Filed: May 19, 2003

(65) Prior Publication Data

US 2004/0236482 A1 Nov. 25, 2004

(51) Int. Cl.[7] ..... G08G 1/123

(52) U.S. Cl. ..... 701/19; 701/213; 701/215; 246/122 R; 340/988

(58) Field of Search ..... 701/19, 20, 200, 701/117, 213, 207, 215; 246/167 R, 182 R, 122 R, 62, 124; 340/903, 988; 342/357.07

(56) References Cited

U.S. PATENT DOCUMENTS

| | | | | |
|---|---|---|---|---|
| 4,181,943 A | | 1/1980 | Mercer, Sr. et al. | 701/20 |
| 4,459,668 A | | 7/1984 | Inoue et al. | 701/20 |
| 4,561,057 A | | 12/1985 | Haley, Jr. et al. | 701/117 |
| 4,711,418 A | | 12/1987 | Aver, Jr. et al. | 246/5 |
| 4,807,127 A | * | 2/1989 | Tenmoku et al. | 701/207 |
| 5,072,900 A | | 12/1991 | Malon | 246/5 |
| 5,129,605 A | | 7/1992 | Burns et al. | 246/5 |
| 5,177,685 A | | 1/1993 | Davis et al. | 455/456.3 |
| 5,332,180 A | | 7/1994 | Peterson et al. | 246/3 |
| 5,340,062 A | | 8/1994 | Heggestad | 246/5 |
| 5,364,047 A | | 11/1994 | Petit et al. | 246/122 R |
| 5,394,333 A | | 2/1995 | Kao | 701/217 |
| 5,398,894 A | | 3/1995 | Pascoe | 246/28 R |

(Continued)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.

"System Architecture, ATCS Specification 100", May 1995.

(Continued)

*Primary Examiner*—Tan Q. Nguyen
(74) *Attorney, Agent, or Firm*—DLA Piper Rudnick Gray Cary US LLP

(57) ABSTRACT

A controller determines that an end of train (EOT) has passed a point through the use of positioning systems at the head of the train (HOT) and the EOT. In a first method, the controller obtains the HOT position at a point of interest from the HOT positioning system. The controller then determines when the train has traveled a distance equal to the length of the train and then interrogates the EOT positioning system. If the difference between this position and the position reported by the HOT positioning system at the point of interest exceeds a threshold, then the EOT has passed the point. In a second method, when the HOT positioning system reaches a point of interest, the position reported by the EOT positioning system is integrated until the total distance traveled by the EOT equals the length of the train.

49 Claims, 6 Drawing Sheets

U.S. PATENT DOCUMENTS

| | | | | | |
|---|---|---|---|---|---|
| 5,452,870 | A | | 9/1995 | Heggestad | 246/182 R |
| 5,533,695 | A | | 7/1996 | Heggestad et al. | |
| 5,620,155 | A | | 4/1997 | Michalek | 246/121 |
| 5,699,986 | A | | 12/1997 | Welk | 246/125 |
| 5,740,547 | A | | 4/1998 | Kull et al. | 701/19 |
| 5,751,569 | A | | 5/1998 | Metel et al. | 700/3 |
| 5,803,411 | A | | 9/1998 | Ackerman et al. | 246/169 R |
| 5,817,934 | A | * | 10/1998 | Skantar | 73/121 |
| 5,828,979 | A | | 10/1998 | Polivka et al. | 701/117 |
| 5,867,122 | A | | 2/1999 | Zahm et al. | 342/357.07 |
| 5,890,682 | A | * | 4/1999 | Welk | 246/125 |
| 5,944,768 | A | | 8/1999 | Ito et al. | 701/200 |
| 5,950,966 | A | | 9/1999 | Hungate et al. | 246/62 |
| 5,969,643 | A | * | 10/1999 | Curtis | 340/988 |
| 5,978,718 | A | | 11/1999 | Kull | 701/19 |
| 5,995,881 | A | | 11/1999 | Kull | 701/20 |
| 6,008,731 | A | * | 12/1999 | Capan | 340/665 |
| 6,049,745 | A | | 4/2000 | Douglas et al. | 701/23 |
| 6,081,769 | A | * | 6/2000 | Curtis | 702/158 |
| 6,102,340 | A | | 8/2000 | Peek et al. | 246/121 |
| 6,112,142 | A | | 8/2000 | Shockley et al. | 701/19 |
| 6,135,396 | A | | 10/2000 | Whitfield et al. | 246/182 R |
| 6,179,252 | B1 | | 1/2001 | Roop et al. | 248/293 |
| 6,218,961 | B1 | | 4/2001 | Gross et al. | 340/903 |
| 6,227,625 | B1 | * | 5/2001 | Gaughan | 303/15 |
| 6,311,109 | B1 | | 10/2001 | Hawthorne et al. | 701/19 |
| 6,322,025 | B1 | | 11/2001 | Colbert et al. | 246/167 R |
| 6,345,233 | B1 | | 2/2002 | Erick | 701/301 |
| 6,371,416 | B1 | | 4/2002 | Hawthorne | 246/122 R |
| 6,373,403 | B1 | | 4/2002 | Korver et al. | 340/988 |
| 6,374,184 | B1 | | 4/2002 | Zahm et al. | 701/213 |
| 6,377,877 | B1 | | 4/2002 | Doner | 701/19 |
| 6,397,147 | B1 | | 5/2002 | Whithead | 701/213 |
| 6,421,587 | B2 | | 7/2002 | Diana et al. | 701/19 |
| 6,456,937 | B1 | | 9/2002 | Doner et al. | 701/213 |
| 6,459,964 | B1 | | 10/2002 | Vu et al. | 701/19 |
| 6,459,965 | B1 | | 10/2002 | Polivka et al. | 701/19 |
| 6,480,766 | B2 | * | 11/2002 | Hawthorne et al. | 701/19 |
| 6,487,478 | B1 | | 11/2002 | Azzaro et al. | 701/24 |
| 6,609,049 | B1 | | 8/2003 | Kane et al. | 701/19 |
| 2001/0056544 | A1 | | 12/2001 | Walker | |
| 2002/0070879 | A1 | | 6/2002 | Gazit et al. | |
| 2003/0225490 | A1 | | 12/2003 | Kane et al. | |

OTHER PUBLICATIONS

"A New World for Communications & Signaling", Progressive Railroading, May 1986.

"Advanced Train Control Gain Momentum", Progressive Railroading, Mar. 1986.

"Railroads Take High Tech in Stride", Progressive Railroading, May 1985.

Lyle, Denise, "Positive Train Control on CSXT", Railway Fuel and Operating Officers Association, Annual Proceedings, 2000, (month is not available).

Lindsey, Ron A., "C B T M, Communications Based Train Management", Railway Fuel and Operating Officers Association, Annual Proceedings, 1999, (month is not available).

Moody, Howard G, "Advanced Train Control Systems A System to Manage Railroad Operations", Railway Fuel and Operating Officers Association, Annual Proceedings, 1993, (month is not available).

Ruegg, G.A., "Advanced Train Control Systems ATCS", Railway Fuel and Operating Officers Association, Annual Proceedings, 1986, (month is not available).

Malone, Frank, "The Gaps Start to Close"Progressive Railroading, May 1987.

"On the Threshold of ATCS", Progressive Railroading, Dec. 1987.

"CP Advances in Train Control", Progressive Railroading, Sep. 1987.

"Communications/Signaling: Vital for dramatic railroad advances", Progressive Railroading, May 1988.

"ATCS's System Engineer", Progressive Railroading, Jul. 1988.

"The Electronic Railroad Emerges", Progressive Railroading, May 1989.

"$C^3$ Comes to the Railroads", Progressive Railroading, Sep. 1989.

"ATCS on Verge of Implementation", Progressive Railroading, Dec. 1989.

"ATCS Evolving on Railroads", Progressive Railroading, Dec. 1992.

"High Tech Advances Keep Railroads Rolling", Progressive Railroading, May 1994.

"FRA Promotes Technology to Avoid Train–To–Train Collisions", Progressive Railroading, Aug. 1994.

"ATCS Moving–slowly but Steadily from Lab for Field", Progressive Railroading, Dec. 1994.

Judge, T., "Electronic Advances Keeping Railroads Rolling", Progressive Railroading, Jun. 1995.

"Electronic Advances Improve How Railroads Manage", Progressive Railroading, Dec. 1995.

Judge, T., "BNSF/UP PTS Pilot Advances in Northwest", Progressive Railroading, May 1996.

Foran, P., "Train Control Quandary, Is CBTC viable? Railroads, Suppliers Hope Pilot Projects Provide Clues", Progressive Railroading, Jun. 1997.

"PTS Would've Prevented Silver Spring Crash: NTSB", Progressive Railroading, Jul. 1997.

Foran, P., "A 'Positive' Answer to the Interoperability Call", Progressive Railroading, Sep. 1997.

Foran, P., "How Safe is Safe Enough?", Progressive Railroading, Oct. 1997.

Foran, P., "A Controlling Interest In Interoperability", Progressive Railroading, Apr. 1998.

Derocher, Robert J., "Transit Projects Setting Pace for Train Control", Progressive Railroading, Jun. 1998.

Kube, K., "Variations on a Theme", Progressive Railroading, Dec. 2001.

Kube, K., "Innovation in Inches", Progressive Railroading, Feb. 2002.

Vantuono, W., "New York Leads a Revolution", Railway Age, Sep. 1996.

Vantuono, W., "Do you know where your train is?", Railway Age, Feb. 1996.

Gallamore, R., "The Curtain Rises on the Next Generation", Railway Age, Jul. 1998.

Burke, J., "How R&D is Shaping the 21st Century Railroad", Railway Age, Aug. 1998.

Vantuono, W., "CBTC: A Maturing Technology", Third International Conference On Communications Based Train Control, Railway Age, Jun. 1999.

Sullivan, T., "PTC—Is FRA Pushing Too Hard?", Railway Age, Aug. 1999.

Sullivan, T., "PTC: A Maturing Technology", Railway Age, Apr. 2000.

Moore, W., "How CBTC Can Increase Capacity", Railway Age, Apr., 2001.

Vantuono, W., "CBTC: The Jury is Still Out", Railway Age, Jun. 2001.

Vantuono, W., "New–tech Train Control Takes Off", Railway Age, May 2002.
Union Switch & Signal Intermittent Cab Signal, Bulletin 53, 1998, (month is not available).
GE Harris Product Sheet: "Advanced Systems for Optimizing Rail Performance" and "Advanced Products for Optimizing train Performance", undated.
GE Harris Product Sheet: "Advanced, Satellite–Based Warning System Enhances Operating Safety", undated.
Furman, E., et al., "Keeping Track of RF", GPS World, Feb. 2001.
Department of Transportation Federal Railroad Administration, Federal Register, vol. 66, No. 155, pp. 42352–42396, Aug. 10, 2001.
Lundsten, Carsten S., "Railroad Rules, Signalling, Operations: Track Warrant Control", Nov. 7, 1998.
Buchanan, Alex, "Service Information Where has the Caboose Gone . . . ", Virginia Railway Express, Commuter Weekly, Mar. 5, 2002.

* cited by examiner

METHOD AND SYSTEM FOR DETECTING WHEN AN END OF TRAIN HAS PASSED A POINT

BACKGROUND OF THE INVENTION

1. Field of the Invention

The invention relates to railroads generally, and more particularly to a method and system for detecting when an end of train passes a point such as a mile marker, switch, siding or other location of interest.

2. Discussion of the Background

It is often important to be able to determine that a railroad has passed a particular point in a railroad. For example, in a train control method known as Track Warrant Control (TWC), a railroad is divided into sections referred to as blocks and a dispatcher gives each train warrants, or authorities, to occupy and/or move in one or more blocks. The blocks are usually (but not necessarily) fixed, with block boundaries usually (but not necessarily) being identified with physical locations on the railroad such as mileposts, sidings, and switches. In this system, a train in a first block (or group of blocks) receives a warrant to occupy a second adjacent block (or group of blocks) from the dispatcher and informs the dispatcher when it has cleared the first block and has entered the following block. After the train notifies the dispatcher that the first block has been cleared, the dispatcher may issue an unrestricted (rather than a "joint" or "permissive" warrant) warrant to occupy the first block to a second train. If such a warrant to occupy the first block is issued to the second train before the end of the first train has cleared that block, a collision between the two trains may result. Therefore, determining that the end of the train has left a block is critical in a track warrant control system.

As another example, it may be necessary to wait until one train has passed a switch so that the switch position can be set in a different direction for a following train. There are yet other examples in which it is necessary to determine that an end of train has passed a point such as the end of a block.

Determining that an end of a train has passed a point is not a trivial process. Modern trains can be hundreds of yards long, and an engineer in the lead locomotive often cannot see the end of the train. Operating trains at night or during bad weather may also make visually determining that the end of a train has passed a point difficult or impossible. Thus, visual methods are not sufficient.

A second method used to determine that the end of a train has passed a point is to determine how far the head of the train has traveled past the point using a wheel tachometer/revolution counter or a positioning system (e.g., a GPS system). With this method, once the head of the train has traveled a distance equal to the length of the train past the point, it is assumed that the end of the train has passed the point. However, with this method, it is important to take into account the possibility that one or more end cars of a train may become uncoupled from the remainder of the train.

One way in which uncoupled cars can be detected is through the use of end-of-train, or EOT, devices equipped with motion detectors. These devices, which communicate via radio with the head of the train (HOT), provide an indication as to whether or not the end of the train is in motion. However, with these devices the motion sensors sometimes break or give false readings and, under certain circumstances, may mislead a conductor or engineer even when working properly. One potentially disastrous incident known to the inventors in which even a properly functioning motion detector can give a misleading indication involves a distributed power train. A distributed power train is a train comprising one or more locomotives placed at the front of the train, followed by one or more cars, followed by one or more additional locomotives and cars. In such a train, the throttles in the second group of locomotives are operated by remote control to be in the same position as the throttles in the first group.

In the above-referenced incident, a distributed power train was temporarily stopped at a crossing. While stopped, a vandal disconnected the second group of locomotives from the preceding car and closed off the valves in the air brake line (had these valves not been closed off, a failsafe mechanism would have activated the brakes to prevent the train from moving). In this particular distributed power train, the second group of cars connected to the second group of locomotives was heavier than the first group of cars connected to the first group of locomotives. Because the second group of cars was heavier than the first, there was a difference in speed between the two portions of the train when the train began moving after being uncoupled by the vandal, and the first portion of the train began to separate from the second portion. The EOT motion sensor transmitted the correct status that the EOT (last car) was moving, but did not (indeed, could not) indicate the train was separated. In this incident, the separation grew to over a mile before the engineer noticed that there was a problem.

If the engineer on this train had relied on the distance traveled by the head of the train to report to the dispatcher that the end of the train had cleared the previous block, then an extremely dangerous situation would have resulted in that the end of the separated train would still have been in the previous block where an oncoming train might have collided with it. Thus, any method used to determine that the end of the train has passed a point should take into account the possibility that the end of the train may have become separated from the head of the train.

One method for detecting that a train has passed a point is discussed in U.S. Pat. No. 6,081,769. In this method, discussed at col. 4, lines 49–67, a second GPS receiver is placed on the end of the train and the position reported by that receiver is used to determine that the end of the train has passed the point of interest. This patent also discloses that the difference in position reported by the first and second GPS receivers can be used to determine the length of the train.

SUMMARY OF THE INVENTION

The present invention determines that an end of train has passed a point through the use of positioning systems located at the head of the train and the end of the train. In a first method, a control unit will obtain the train's position at a point of interest (e.g., a switch or block boundary) from the HOT positioning system. The control unit will then determine when the train has traveled a distance equal to the length of the train. This can be done either by integrating successive reports from the positioning system (that is, determining a difference in position between successive reports and adding the differences to determine a total distance), or by periodically determining a distance between the position of the point of interest and the position reported by the positioning system until such time as the distance is greater than the length of the train. When the distance traveled by the head of the train equals or exceeds the length of the train, the control unit will interrogate the positioning system at the end of the train. If the difference between this position and the position reported by the head-of-train positioning system at the point of interest exceeds a threshold, then the end of the train has passed the point. While it is possible to set the threshold to zero, the threshold is chosen to include a safety factor to account for, among other things, positioning system errors. As an additional check, the speeds reported by the end-of-train and head-of-train positioning systems can be compared to verify that the difference in speeds is approximately zero (a small difference is preferably allowed to account for positioning system errors and slack between cars which can allow the cars at the end of the train to have a slightly different speed as compared to the locomotive at the head of the train at any given moment).

In a second method, when the HOT positioning system reaches a point of interest, the position reported by the EOT positioning system is integrated until the total distance traveled by the end of the train equals the length of the train (again, a safety factor is preferably included). If the speed reported by the EOT positioning system matches (allowing for positioning system errors) the speed reported by the HOT positioning system when the integrated distance equals the length of the train, the end of the train has passed the point.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of the invention. Specific details, such as types of positioning systems and threshold distances, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
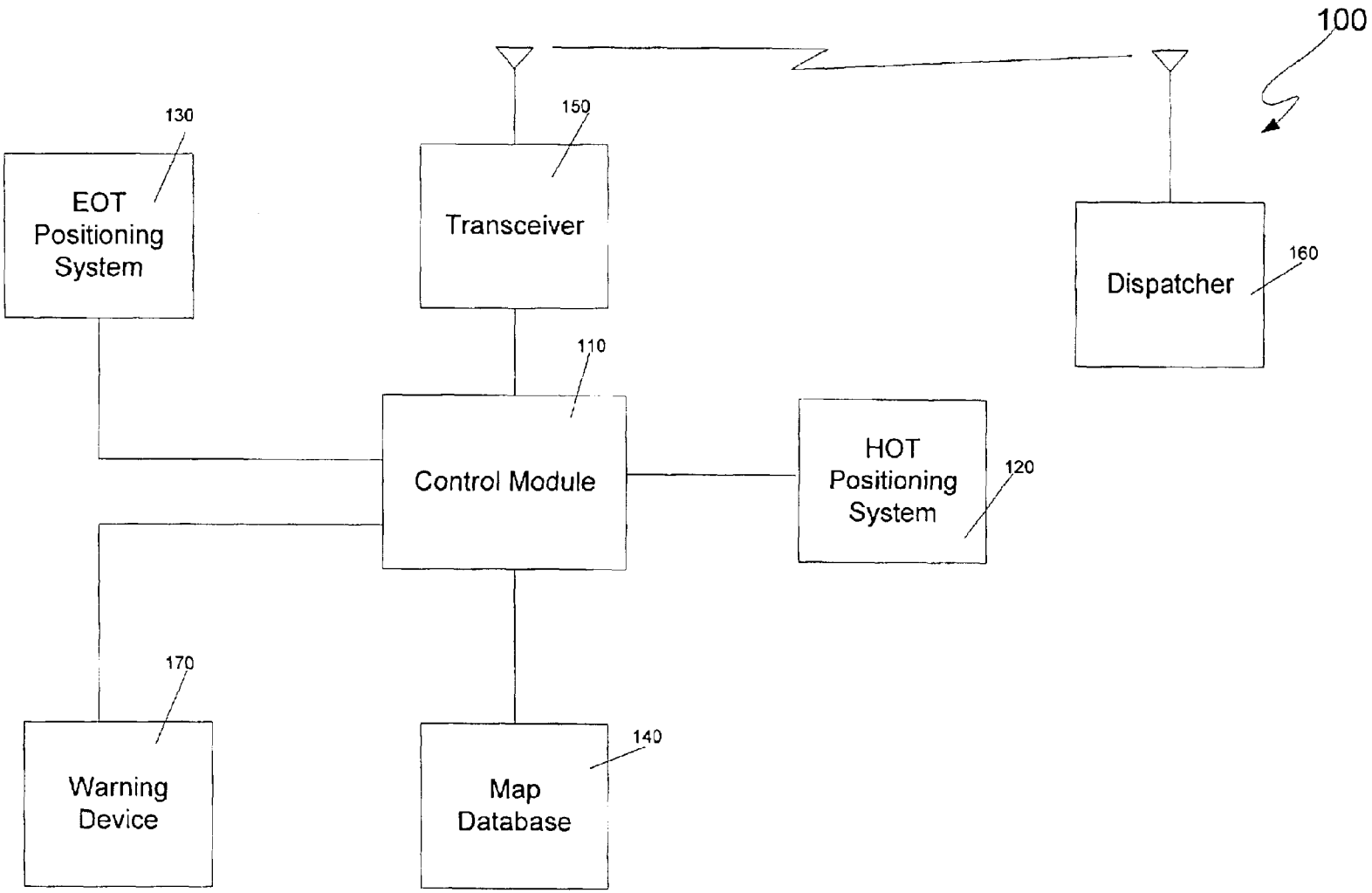
FIG. 1 is a logical block diagram of a system for determining that the end of a train has passed a point according to one embodiment of the invention.

Referring now to the drawings, wherein like reference numerals designate identical or corresponding parts throughout the several views, FIG. 1 is a logical block diagram of a train control system 100 according to an embodiment of the present invention. The system 100 includes a control module 110 which typically, but not necessarily, includes a microprocessor. The control module 110 is responsible for controlling the other components of the system and performing the mathematical calculations discussed further below.

A head of train positioning system 120 and an end of train positioning system 130 are connected to the control module 110. The positioning systems supply the position and, preferably, the speed of the train to the control module 110. The positioning systems 120, 130 can be of any type, including global positioning systems (GPS), differential GPSs, inertial navigation systems (INS), or Loran systems. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that transmit information to the GPS receiver.)

A map database 140 is also connected to the control module 110. The map database 130 preferably comprises a non-volatile memory such as a hard disk, flash memory, CD-ROM or other storage device, on which map data is stored. Other types of memory, including volatile memory, may also be used. The map data preferably includes positions of all points of interest such as block boundaries, switches, sidings, etc. The map data preferably also includes information concerning the direction and grade of the track in the railway. By using train position information obtained from the positioning systems 120, 130 and information from the map database 140, the control module 110 can determine its position relative to points of interest.

Some embodiments of the invention also include a transceiver 150 connected to the control module 110 for communicating with a dispatcher 160. The transceiver 150 can be configured for any type of communication, including communication through rails and wireless communication.

Also connected to the control module 110 in some embodiments of the invention is a warning device 170. The warning device 170 is used to alert the operator to a possible error condition such as the separation of the EOT from the HOT. The warning device 170 may comprise audible warning devices such as horns and beepers and/or visual warning devices such as lights or alphanumeric and graphic displays.

Figure 2A:
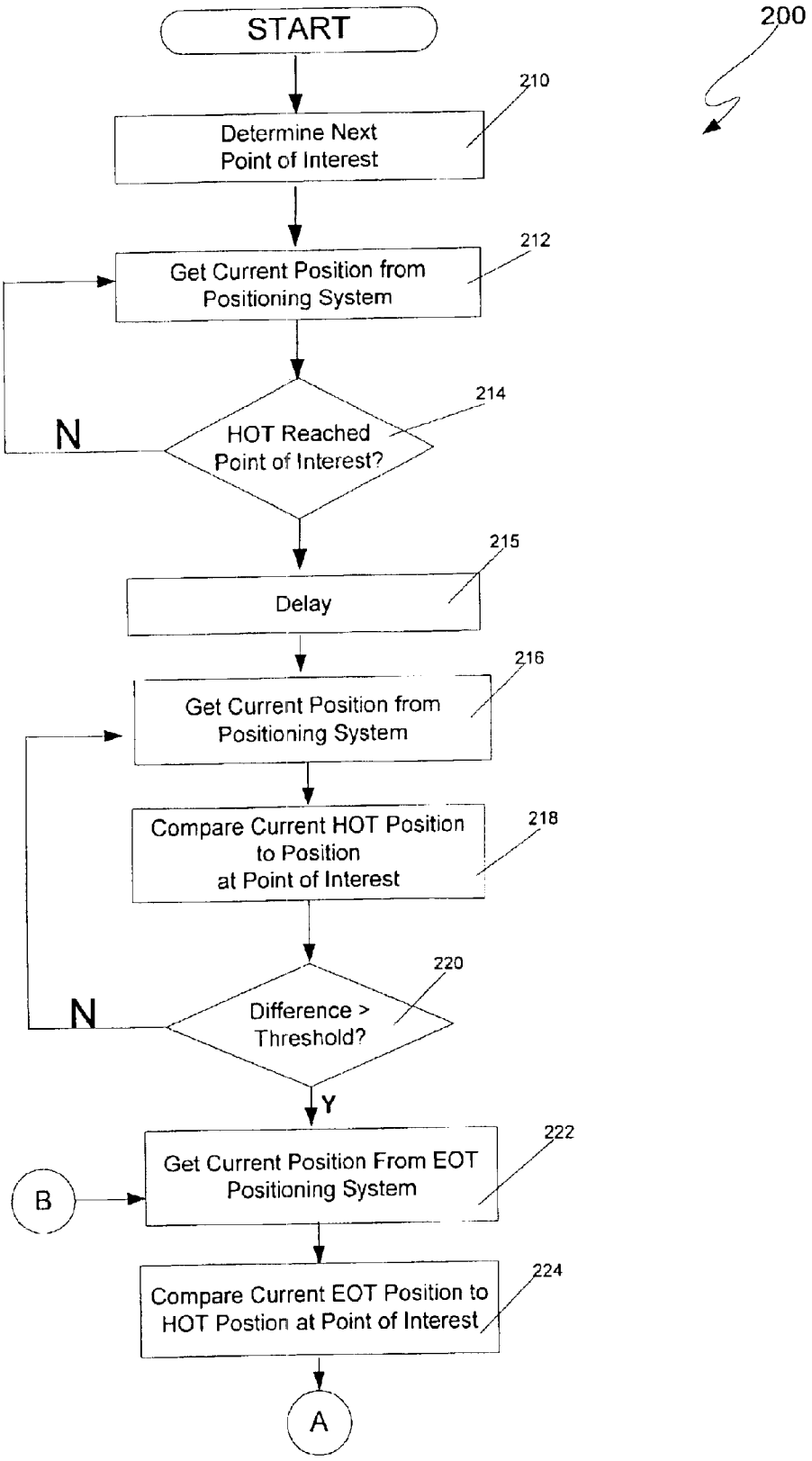
FIG. 2 is a flow chart of a method for determining that an end of a train has passed a point that is performed by the system of FIG. 1.
Figure 2B:
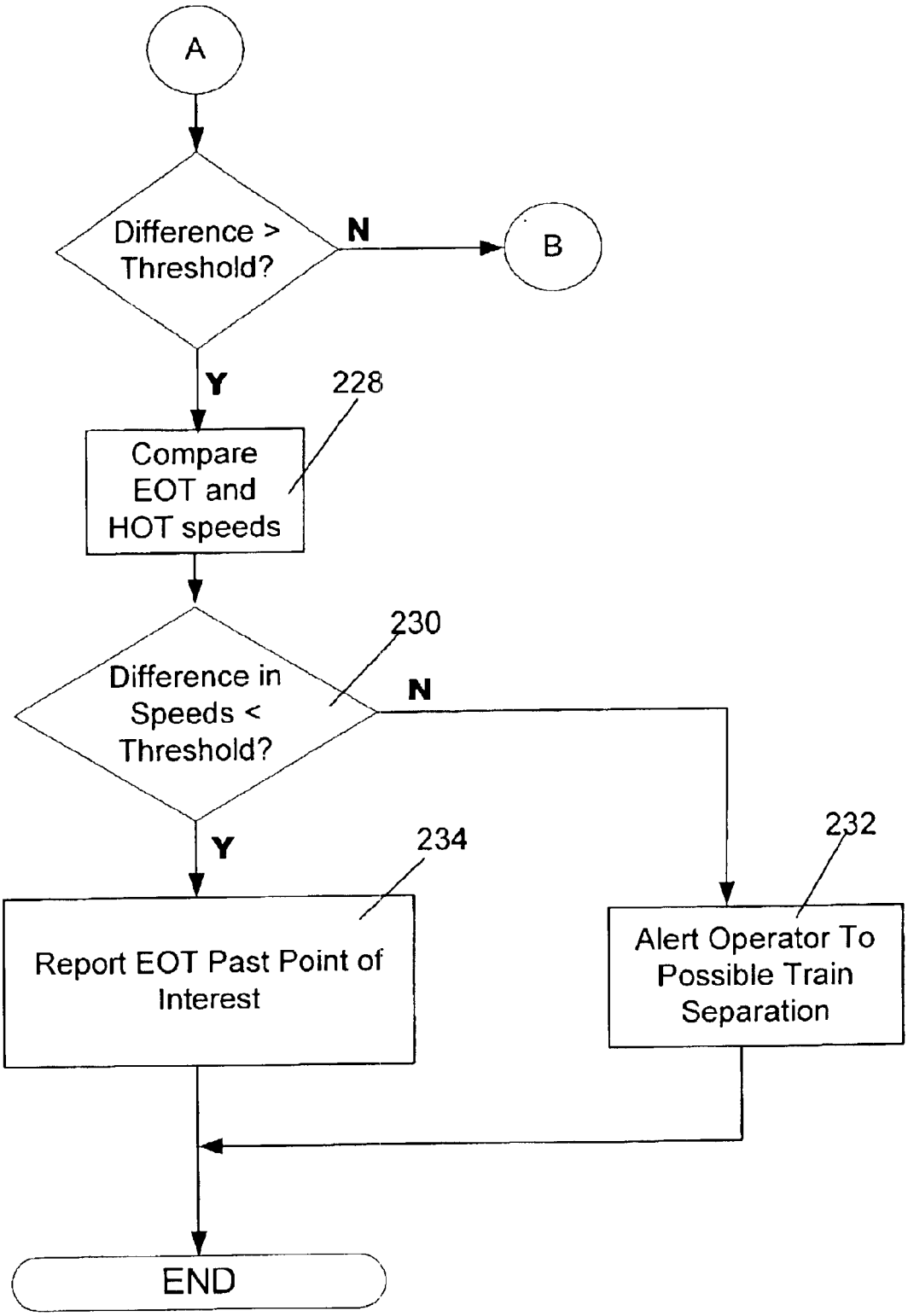

FIG. 2 is a flowchart 200 illustrating operation of the control module 110 according to one embodiment of the invention. The control module 110 determines the location of the next point of interest at step 200. The next point of interest may be determined in any number of ways including, for example, using information from the map database 140, or it may be obtained from a dispatcher (e.g., in a warrant/authority). The control module then obtains the train's current position from information provided by the HOT positioning system 120 at step 212. If the current train position as reported by the HOT positioning system 120 indicates that the HOT has not yet reached the point of interest at step 214, step 212 is repeated.

When the HOT has reached the point of interest at step 214, the control module then delays for a short period of time (e.g., 1 second) at step 215 and obtains the current HOT position from the HOT positioning system 120 at step 216. This position is compared with the HOT position at the point of interest at step 218. If the difference is not greater than a length of train threshold at step 220, step 216 is repeated. The length of train threshold includes the length of the train and, preferably, a safety factor to account for positioning system errors. The length of the train may be reported to the control module 110 by the dispatcher, or the dispatcher's computer, may be entered manually by the operator, or may be determined using any other method, including the methods disclosed in U.S. Pat. Nos. 6,081,769 and 6,311,109.

If the distance traveled by the HOT exceeds the length of the train at step 220, the position of the end of the train as reported by EOT positioning system 130 is obtained at step 222. This position is compared to the position obtained (at step 212) from the HOT positioning system at the point of interest at step 224. If this difference does not exceed a threshold at step 226, step 222 is repeated. The threshold utilized in step 226 is nominally zero but preferably includes a safety margin to account for positioning system errors.

If the difference exceeds the threshold at step 226 (signifying that the end of the train has passed the point of interest), the speeds reported by the EOT and HOT positioning systems is compared at step 228. The purpose of this comparison is to ensure that the EOT and HOT are not traveling at significantly different speeds, which would be indicative of a train separation. If the difference in EOT and HOT speeds is greater than a threshold (again, nominally zero but preferably including a safety factor to account for differences in speed caused by slack between cars in train and positioning system errors) at step 230, then the control module 110 warns the operator of a possible train separation at step 232. If the difference in EOT and HOT speeds is less than the threshold at step 230, then the control module 110 reports (e.g., to the dispatcher 160 via the transceiver 150) that the end of the train has passed the point of interest at step 234.

Figure 3:
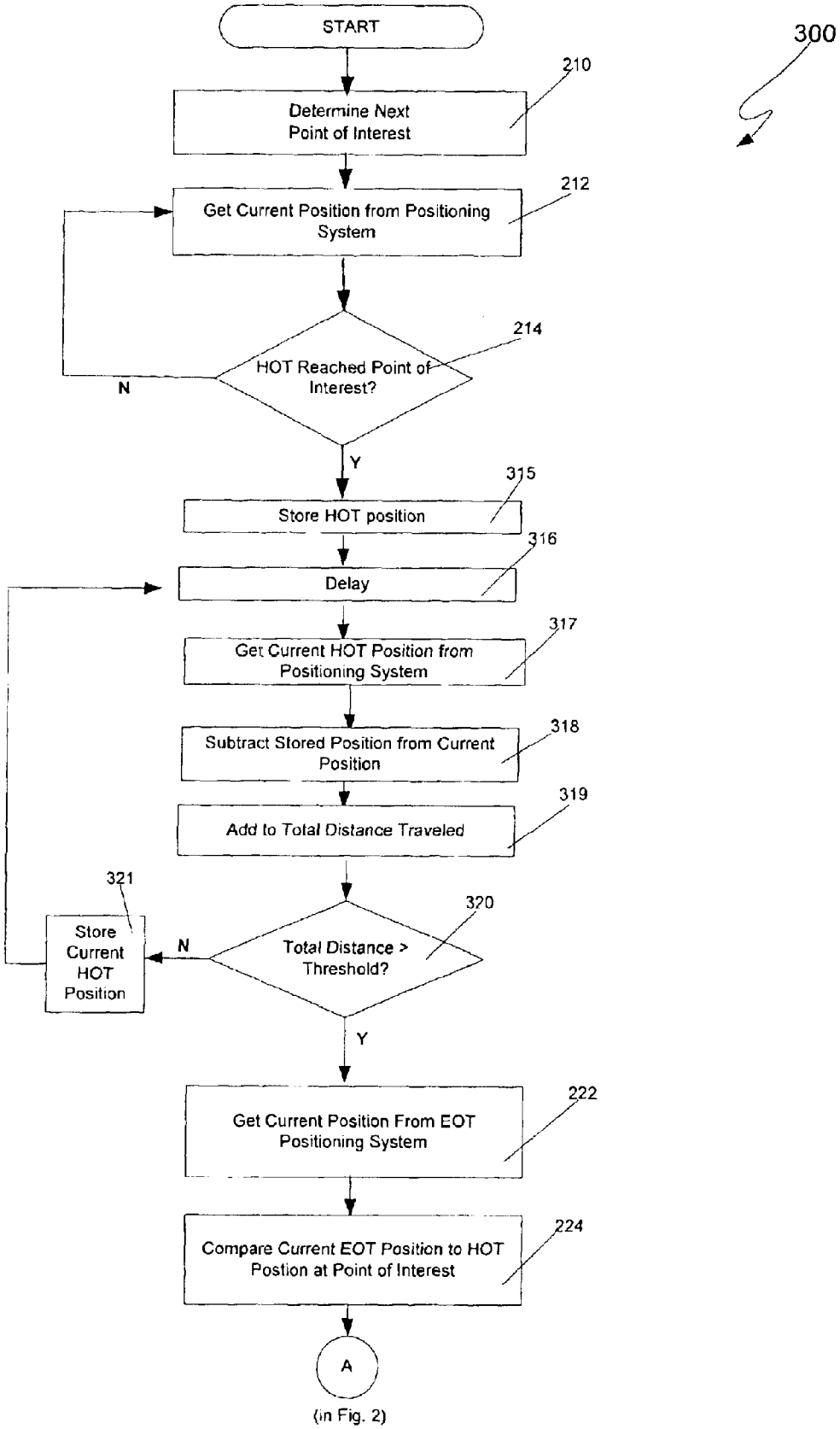
FIG. 3 is a flow chart of a method for determining that an end of a train has passed a point that is performed by the system of FIG. 1 according to a second embodiment of the invention.

FIG. 3 is a flowchart of the operation of the control module 110 according to a second embodiment of the invention. The method illustrated in FIG. 3 is similar to the method illustrated in FIG. 2, but differs in the way in which the control module 110 determines that the head-of-train has traveled a distance equal to the length of the train. The step in the method of FIG. 2 can be peformed by successively querying the GPS system to determine the distance between the point of interest and the current head-of-train location. The distance may be determined by simply calculating a linear distance, but doing so can be disadvantageous in that, for curved sections of track, the linear distance will be shorter than the true "track distance" (i.e., the distance that the train has traveled over the track), which will result in an unnecessary delay in determining that the HOT has traveled a distance equal to the length of the train. This step may also be performed using track information stored in the map database 140 to calculate the true track distance, but such calculations are necessarily more complex. In the method of FIG. 3, an integration method is used whereby the differences in position over short distances is summed. This method has the benefit of using simple linear calculations but also approximates the true track distance because the calculations are performed frequently (e.g, every 1 second).

Referring now to FIG. 3, steps 210–214 are the same as described above in connection with FIG. 2. When the HOT has reached the point of interest at step 214, the HOT position is stored in a temporary register at step 315. The system then delays for a short period (e.g., 1 second) at step 316. The control module 110 then obtains the current HOT position from the HOT positioning system 120 at step 317, subtracts this position from the previously stored HOT position at step 318, and adds the difference to the sum of total distance traveled at step 319. If the total distance traveled does not exceed a threshold equal to the length of the train plus a safety margin at step 320, the current HOT position is stored in the temporary register at step 321 and steps 316 et seq. are repeated. If the sum of the total distance does exceed the threshold at step 320, steps 222 et seq., which are identical to the correspondingly-numbered steps in FIG. 2, are repeated.

Figure 4A:
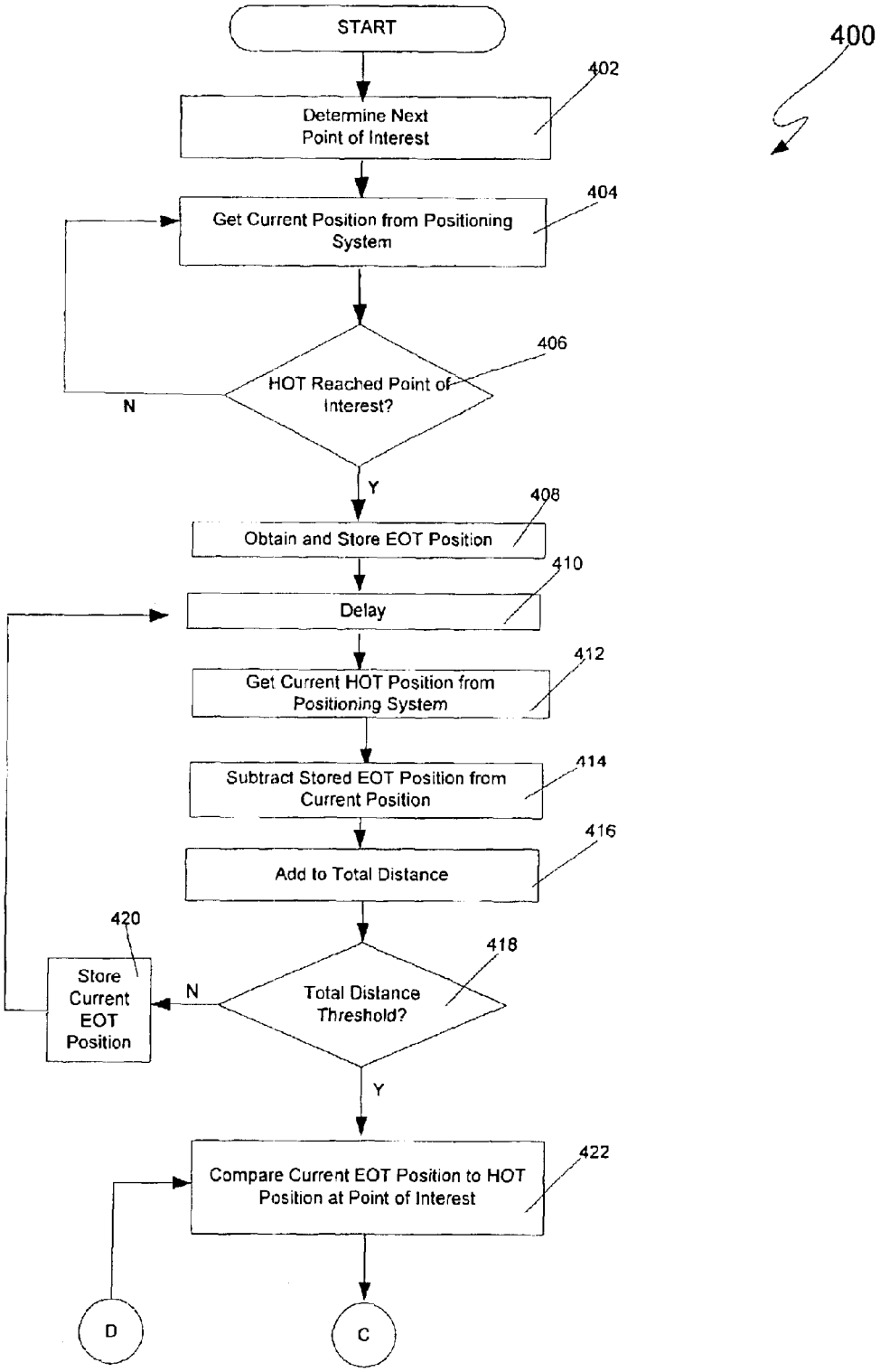
FIG. 4 is a flow chart of a method for determining that an end of a train has passed a point that is performed by the system of FIG. 1 according to a third embodiment of the invention.
Figure 4B:
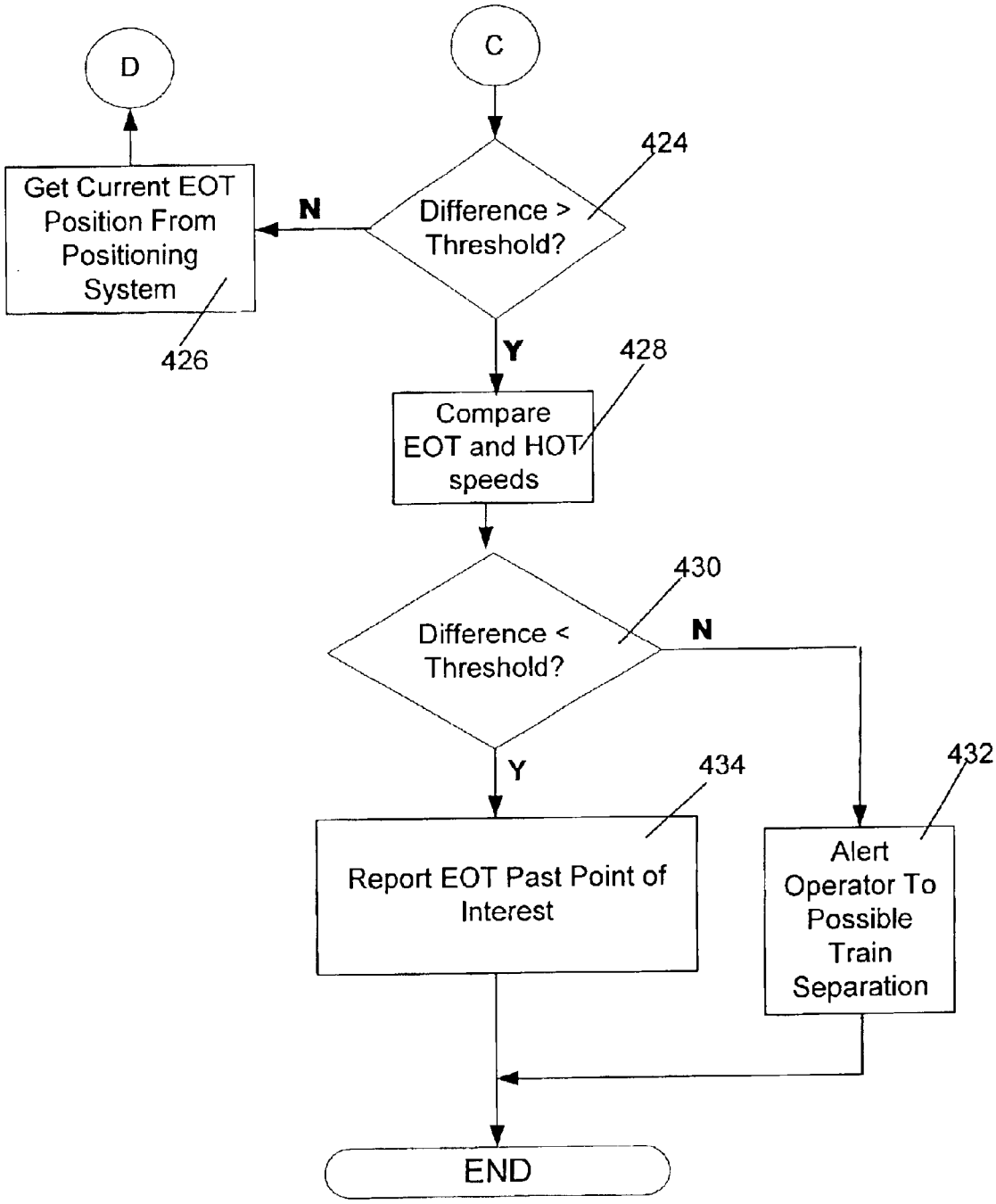

FIG. 4 is a flowchart 400 illustrating the operation of the control module 110 according to a third embodiment of the invention. The control module 110 determines the location of the next point of interest at step 402. As discussed above, the next point of interest may be determined in any number of ways including, for example, using information from the map database 140, or it may be obtained from a dispatcher (e.g., in a warrant/authority). The control module 110 then obtains the train's current position from information provided by the HOT positioning system 120 at step 404. If the current train position as reported by the HOT positioning system 120 indicates that the HOT has not yet reached the point of interest at step 406, step 404 is repeated.

When the HOT has reached the point of interest at step 406, the control module 110 then obtains the current EOT position from the EOT positioning system 130 and temporarily stores it at step 408. The control module 110 then delays a short period (e.g., 1 second). After the delay, the current EOT position is obtained at step 412, the difference between this position and the previously stored EOT position is calculated at step 414 and this difference is added to a total distance (the total distance that the EOT has traveled since the HOT passed the point of interest) at step 416. If the total distance is not greater than a length of train threshold at step 418, the current EOT positioned is stored at step 420 and steps 410 et seq. are repeated.

If the distance traveled by the EOT exceeds the length of the train at step 418, the position of the end of the train as reported by EOT positioning system 130 is compared to the position obtained (at step 406) from the HOT positioning system at the point of interest at step 422. If this difference does not exceed a threshold at step 424, the current EOT position is again obtained at step 426 and step 422 is repeated. As above, the threshold utilized in step 424 may be zero but preferably includes a safety margin to account for positioning system errors.

If the difference exceeds the threshold at step 424 (signifying that the end of the train has passed the point of interest), the speeds reported by the EOT and HOT positioning systems are compared at step 428. The purpose of this comparison is to ensure that the EOT and HOT are not traveling at significantly different speeds, which would be indicative of a train separation. If the difference in EOT and HOT speeds is greater than a threshold (again, nominally zero but preferably including a safety factor to account for differences in speed caused by slack between cars in train and positioning system errors) at step 430, then the control module 110 warns the operator of a possible train separation at step 432. If the difference in EOT and HOT speeds is less than the threshold at step 430, then the control module 110 reports (e.g., to the dispatcher 160 via the transceiver 150) that the end of the train has passed the point of interest at step 434.

It should be noted that the comparison of speeds between the HOT and EOT positioning systems 120, 130, while preferable because it adds an additional degree of safety, is not strictly necessary.

Obviously, numerous modifications and variations of the present invention are possible in light of the above teachings. It is therefore to be understood that within the scope of the appended claims, the invention may be practiced otherwise than as specifically described herein.

What is claimed is:

1. A method for determining that an end of train has passed a point comprising the steps of:

determining that a head of a train has reached a first position at a point of interest;

detecting, after the determining step, that the head of the train has traveled a distance past the first position, the distance being at least as long as a length of the train;

obtaining a second position of an end of the train after the detecting step; and comparing the first position to the second position to verify that the end of the train has passed the point of interest.

2. The method of claim 1, wherein the comparing step is performed by calculating a difference between the first position and the second position and comparing the difference to a threshold.

3. The method of claim 2, wherein the threshold is zero.

4. The method of claim 2, wherein the threshold includes a safety factor.

5. The method of claim 1, wherein the step of determining that the head of train has traveled the distance is performed by integrating successive differences in position of the head of the train.

6. The method of claim 5, wherein the integrating step is performed at a periodic rate.

7. The method of claim 6, wherein the periodic rate is approximately once every second.

8. The method of claim 1, wherein the step of determining that the head of train has traveled the distance is performed by determining a third position of the head of the train at a time after the head of the train is at the first position and calculating a difference between the third position and the first position.

9. The method of claim 1, further comprising the step of accepting a length of the train from a dispatcher.

10. The method of claim 1, further comprising the step of accepting a length of the train from an operator.

11. The method of claim 1, further comprising the step of determining a length of the train based at least in part on a position reported by a positioning system located at an end of the train and a position reported by a positioning system located at a head of the train.

12. The method of claim 1, wherein the first position is obtained from a first positioning system located at the head of the train and the second position is obtained from a second positioning system located at an end of the train.

13. The method of claim 11, wherein the positioning system located at the end of the train is a Global Positioning System (GPS) receiver and the positioning system located at the head of the train is a GPS receiver.

14. The method of claim 12, further comprising the step of comparing a speed reported by the first positioning system to a speed reported by the second positioning system to detect a separation of the head of the train from the end of the train.

15. A method for determining that an end of train has passed a point comprising the steps of:

determining that a head of a train has reached a first position at a point of interest;

detecting, after the determining step, that an end of the train has traveled a distance at least as long as a length of the train;

obtaining a second position of the end of the train after the detecting step; and comparing the first position to the second position to verify that the end of the train has passed the point of interest.

16. The method of claim 15, wherein the comparing step is performed by calculating a difference between the first position and the second position and comparing the difference to a threshold.

17. The method of claim 16, wherein the threshold is zero.

18. The method of claim 16, wherein the threshold includes a safety factor.

19. The method of claim 15, wherein the detecting step is performed by integrating successive differences in position of the end of the train.

20. The method of claim 19, wherein the integrating step is performed at a periodic rate.

21. The method of claim 20, wherein the periodic rate is approximately once every second.

22. The method of claim 15, further comprising the step of accepting the length of the train from a dispatcher.

23. The method of claim 15, further comprising the step of determining the length of a train based at least in part on a position reported by a positioning system located at an end of the train and a position reported by a positioning system located at a head of the train.

24. The method of claim 15, wherein the first position is obtained from a first positioning system located at the head of the train and the second position is obtained from a second positioning system located at an end of the train.

25. The method of claim 24, further comprising the step of comparing a speed reported by the first positioning system to a speed reported by the second positioning system to detect a separation of the head of the train from the end of the train.

26. A system for determining that an end of train has passed a point, the system comprising:

a control unit;

a first positioning system in communication with the control unit, the first positioning system being located at a head of a train;

a second positioning system in communication with the control unit, the second positioning system being located at an end of the train;

the control unit being configured to perform the steps of determining when a head of a train has reached a first position at a point of interest using information from the first positioning system;

detecting when the head of the train has traveled a distance past the first position, the distance being at least as long as a length of the train;

obtaining a second position of an end of the train from the second positioning system when the head of train has traveled the distance; and comparing the first position to the second position to verify that the end of the train has passed the point of interest.

27. The system of claim 26, wherein the comparing step is performed by calculating a difference between the first position and the second position and comparing the difference to a threshold.

28. The system of claim 27, wherein the threshold is zero.

29. The system of claim 27, wherein the threshold includes a safety factor.

30. The system of claim 26, wherein the step of determining that the head of train has traveled the distance is performed by integrating successive differences in position of the head of the train.

31. The system of claim 30, wherein the integrating step is performed at a periodic rate.

32. The system of claim 31, wherein the periodic rate is approximately once every second.

33. The system of claim 26, wherein the step of determining that the head of train has traveled the distance is performed by determining a third position of the head of the train at a time after the head of the train is at the first position and calculating a difference between the third position and the first position.

34. The system of claim 26, further comprising the step of accepting the length of the train from a dispatcher.

35. The system of claim 26, further comprising the step of determining a length of a train based at least in part on a position reported by the first positioning system and a position reported by the second positioning system.

36. The system of claim 26, wherein the first and second positioning systems are GPS receivers.

37. The system of claim 26, wherein the control unit is further configured to perform the step of comparing a speed reported by the first positioning system to a speed reported by the second positioning system to detect a separation of the head of the train from the end of the train.

38. The system of claim 26, further comprising a storage device connected to the control unit, the control unit further being configured to obtain the point of interest from the track database.

39. A system for determining that an end of train has passed a point, the system comprising:

a control unit;

a first positioning system in communication with the control unit, the first positioning system being located at a head of a train;

a second positioning system in communication with the control unit, the second positioning system being located at an end of the train;

the control unit being configured to perform the steps of determining a first position of a head of a train at a point of interest;

detecting, after the determining step, when an end of the train has traveled a distance at least as long as a length of the train;

obtaining a second position of the end of the train after the detecting step; and comparing the first position to the second position to verify that the end of the train has passed the point of interest.

40. The system of claim 39, wherein the comparing step is performed by calculating a difference between the first position and the second position and comparing the difference to a threshold.

41. The system of claim 40, wherein the threshold is zero.

42. The system of claim 40, wherein the threshold includes a safety factor.

43. The system of claim 39, wherein the detecting step is performed by integrating successive differences in position of the end of the train.

44. The system of claim 43, wherein the integrating step is performed at a periodic rate.

45. The system of claim 44, wherein the periodic rate is approximately once every second.

46. The system of claim 39, wherein the control unit is further configured to perform the step of accepting the length of a train from a dispatcher.

47. The system of claim 39, wherein the control unit is further configured to perform the step of determining the length of the train based at least in part on a position reported by the first positioning system and a position reported by the second positioning system.

48. The system of claim 39, further comprising the step of comparing a speed reported by the first positioning system to a speed reported by the second positioning system to detect a separation of the head of the train from the end of the train.

49. The system of claim 39, further comprising a storage device connected to the control unit, the control unit further being configured to obtain the point of interest from the track database.

* * * * *